US010138666B2

(12) United States Patent
Chiu

(10) Patent No.: US 10,138,666 B2
(45) Date of Patent: Nov. 27, 2018

(54) ANTI-FALL FLIP-UP SLIDING MECHANISM

(71) Applicant: Nan Juen International Co., Ltd., New Taipei (TW)

(72) Inventor: I-Hsiang Chiu, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 15/469,560

(22) Filed: Mar. 26, 2017

(65) Prior Publication Data

US 2018/0274276 A1 Sep. 27, 2018

(51) Int. Cl.

| | |
|---|---|
| ***E05D 15/00*** | (2006.01) |
| ***E05D 15/58*** | (2006.01) |
| ***A47B 96/00*** | (2006.01) |
| ***E05F 3/02*** | (2006.01) |
| ***E05D 3/02*** | (2006.01) |
| ***E05F 3/04*** | (2006.01) |
| ***E05F 3/14*** | (2006.01) |
| ***E05F 3/20*** | (2006.01) |

(52) U.S. Cl.

CPC ..... *E05D 15/583* (2013.01); *A47B 96/00* (2013.01); *E05D 3/022* (2013.01); *E05F 3/02* (2013.01); *E05F 3/04* (2013.01); *E05F 3/14* (2013.01); *E05F 3/20* (2013.01); *E05D 2015/585* (2013.01); *E05Y 2201/212* (2013.01); *E05Y 2900/20* (2013.01)

(58) Field of Classification Search

CPC ..... Y10T 16/35; Y10T 16/5383; Y10T 16/53885; Y10T 16/54048; E05D 15/583; E05D 15/58; E05D 15/582; E05D 15/56; E05D 15/565; E05D 3/022; E05D 3/02; E05D 3/04; E05D 3/14; E05D 3/20; E05D 15/585; E05D 13/003; E05D 13/006; E05D 13/1215; E05D 13/1238; E05D 13/1261; E05D 13/1284; E05D 15/42; E05D 15/401; A47B 96/00; E05Y 2201/21; E05Y 2201/212; E05Y 2900/20; E05Y 2201/266; E05F 5/02; E05F 5/003

See application file for complete search history.

(56) References Cited

U.S. PATENT DOCUMENTS

RE28,994 E * 10/1976 Aylworth ..... E06B 3/5045 312/139.2
5,524,979 A * 6/1996 Carson ..... E05D 15/582 16/362
5,645,333 A * 7/1997 Sakurai ..... E05D 15/582 16/DIG. 9
5,758,937 A * 6/1998 Lammens ..... E05D 15/582 16/84

(Continued)

*Primary Examiner* — Chuck Y Mah

(57) ABSTRACT

An anti-fall flip-up sliding mechanism includes a hinge having a first hinge plate affixed to a cabinet and a second hinge plate pivotally connected the first hinge plate, a buffering device including a first damper connected between the first hinge plate and the second hinge plate and a second damper mounted at the second hinge plate, and a sliding device affixed to a door panel and slidably coupled to the second hinge plate and meshed with the second damper such that when the door panel is biased relative to the first hinge plate and received to the top side of the cabinet, the first damper and the second damper produce a buffering effect to avoid the door panel from sudden falling.

4 Claims, 5 Drawing Sheets

(56) References Cited

U.S. PATENT DOCUMENTS

| | | | | |
|---|---|---|---|---|
| 5,971,514 | A * | 10/1999 | Hayakawa | E05D 15/582 16/291 |
| 6,296,337 | B1 * | 10/2001 | Kawanabe | E05D 15/408 312/319.2 |
| 7,987,555 | B2 * | 8/2011 | Chen | E05D 15/582 16/286 |
| 8,256,064 | B2 * | 9/2012 | Blersch | E05D 3/18 16/286 |
| 9,523,227 | B1 * | 12/2016 | Huang | E05F 5/10 |
| 2002/0096405 | A1 * | 7/2002 | Gasser | F16F 7/08 188/82.1 |
| 2008/0244862 | A1 * | 10/2008 | Tooyama | E05F 5/003 16/82 |
| 2009/0115115 | A1 * | 5/2009 | Zeilenga | E05F 5/00 267/69 |
| 2016/0319582 | A1 * | 11/2016 | Grabher | E05F 5/003 |

* cited by examiner

ANTI-FALL FLIP-UP SLIDING MECHANISM

BACKGROUND OF THE INVENTION

1. Field of the Invention

The present invention relates to flip-up furniture and more particularly, to an anti-fall flip-up sliding mechanism for use in a cabinet with a flip-up door panel to prevent the door panel from sudden falling during operation.

2. Description of the Related Art

In order to facilitate the use and to save space installation space, an office furniture, filing cabinet, kitchen cabinet, wardrobe, bookcase, hanging cabinet or TV cabinet can be equipped with a flip-up door panel that can be biased upwards and then received to the top side of the cabinet. When closing the cabinet, the flip-up door panel is pulled out of the top side of the cabinet and then turned downward and covered on the front side of the cabinet. However, when pulling the flip-up door panel out of the top side of the cabinet, the heavy flip-up door panel can fall down suddenly, if the user does not positively grasp the flip-up door panel, letting the user injured.

SUMMARY OF THE INVENTION

The present invention has been accomplished under the circumstances in view. It is therefore the main object of the present invention to provide an anti-fall flip-up sliding mechanism, which is practical for use in a cabinet with a flip-up door panel, avoiding the door panel from sudden falling during operation.

To achieve this and other objects of the present invention, an anti-fall flip-up sliding mechanism comprises a hinge, a buffering device and a buffering device. The hinge comprises a first hinge plate affixed to a cabinet, and a second hinge plate pivotally connected to the first hinge plate. The buffering device comprises a first damper connected between the first hinge plate and the second hinge plate, and a second damper mounted at the second hinge plate. The sliding device is coupled to and slidable relative to the second hinge plate of the hinge and meshed with the second damper of the buffering device. Further, the sliding device is affixed to a door panel, enabling the door panel to be biased relative to the first hinge plate and received to a top side of the cabinet, and buffered by the first damper and the second damper and prevented from sudden falling when it is biased relative to the first hinge plate and the cabinet.

DETAILED DESCRIPTION OF THE PREFERRED EMBODIMENT

Figure 1:
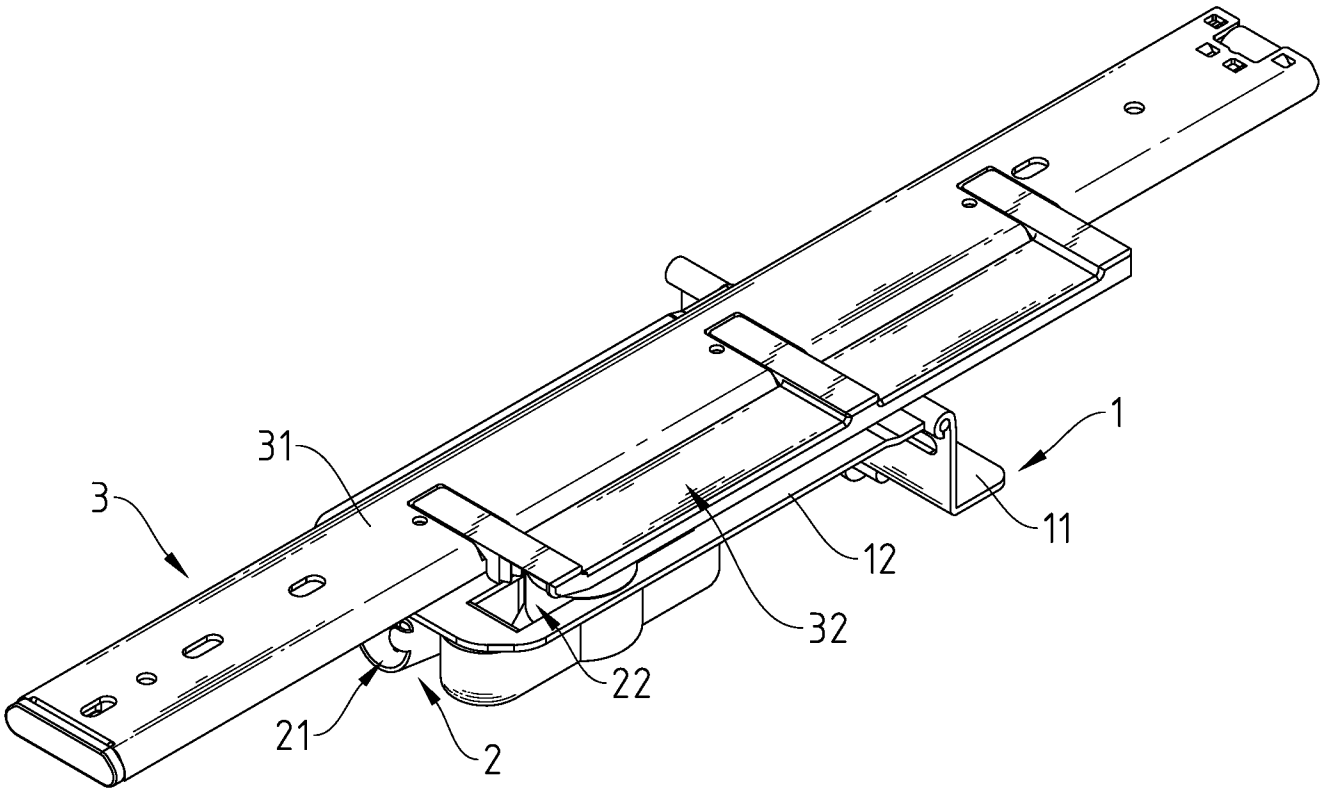
FIG. 1 is an oblique top elevational view of an anti-fall flip-up sliding mechanism in accordance with the present invention.

Referring to FIGS. 1-4, an anti-fall flip-up sliding mechanism in accordance with the present invention is shown. The anti-fall flip-up sliding mechanism comprises a hinge 1, a buffering device 2 and a sliding device 3.

The hinge 1 comprises a first hinge plate 11, a second hinge plate 12 and a track member 13. The first hinge plate 11 and the second hinge plate 12 have a respective one end pivotally connected to each other. The track member 13 is fixedly mounted at the second hinge plate 12, comprising an elongated track base 131 affixed to the second hinge plate 12, and two upright position-limiting side panels 132 extending along two opposite lateral sides of the track base 131 in a parallel manner.

The buffering device 2 comprises a first damper 21 and a second damper 22. The first damper 21 is connected to the first hinge plate 11 and the second hinge plate 12. The second damper 22 is mounted at the second hinge plate 12. The first damper 21 comprises a first cylinder 211, and a piston rod 212 coupled to and movable in and out of the first cylinder 211. The first cylinder 211 is affixed to the second hinge plate 12. The piston rod 212 has the distal end thereof pivotally connected to the first hinge plate 11. The second damper 22 comprises a second cylinder 221, a transmission axle 222 coupled to the second cylinder 221, and a transmission gear 223 fixedly mounted on the transmission axle 222. The second cylinder 221 is fixedly mounted at the second hinge plate 12. Further, the first cylinder 211 and the second cylinder 221 can be hydraulic cylinders, or pneumatic cylinders.

The sliding device 3 comprises a sliding seat 31, and a connecting seat 32 mounted at the sliding seat 31. The sliding seat 31 defines therein a sliding groove 311. The track member 13 of the hinge 1 is coupled to the sliding groove 311 with the two upright position-limiting side panels 132 thereof respectively supported on the two opposite inner sidewalls of the sliding groove 311. Thus, the sliding seat 31 is coupled to and movable forward and backward relative to the track member 13. The connecting seat 32 comprises a position-limiting groove 321, and a tooth rack 322 extended along one lateral side of the position-limiting groove 321. The transmission gear 223 of the buffering device 2 is disposed in the position-limiting groove 321 of the connecting seat 32 and meshed with the tooth rack 322.

In application, the first hinge plate 11 of the aforesaid hinge 1 is affixed to a cabinet 4, and the sliding device 3 is connected to a door panel 5, allowing the door panel 5 to be flipped up relative to the first hinge plate 11 and the cabinet 4 and received to a top side of the cabinet 4.

Figure 2:
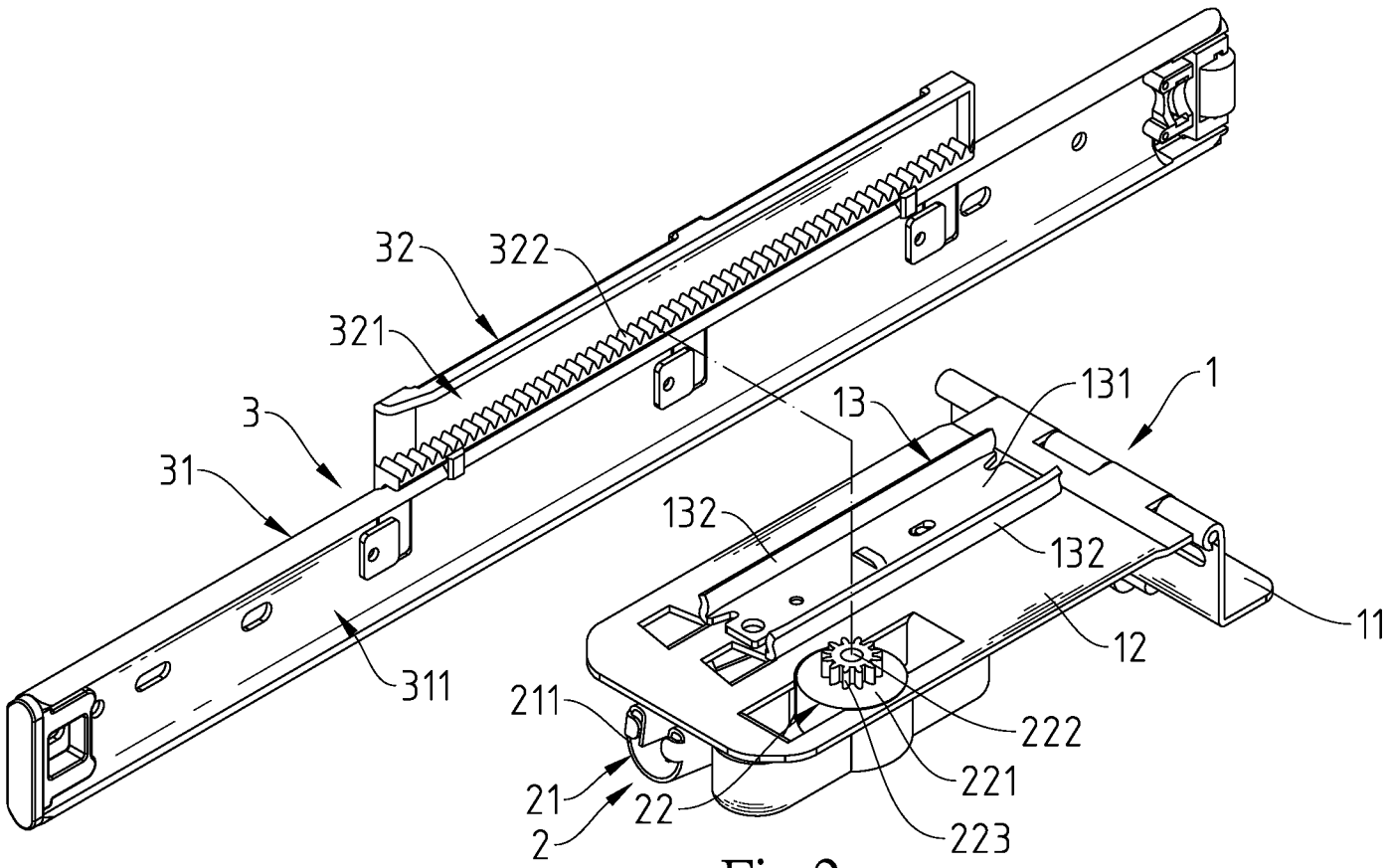
FIG. 2 is an exploded view of the anti-fall flip-up sliding mechanism in accordance with the present invention.
Figure 3:
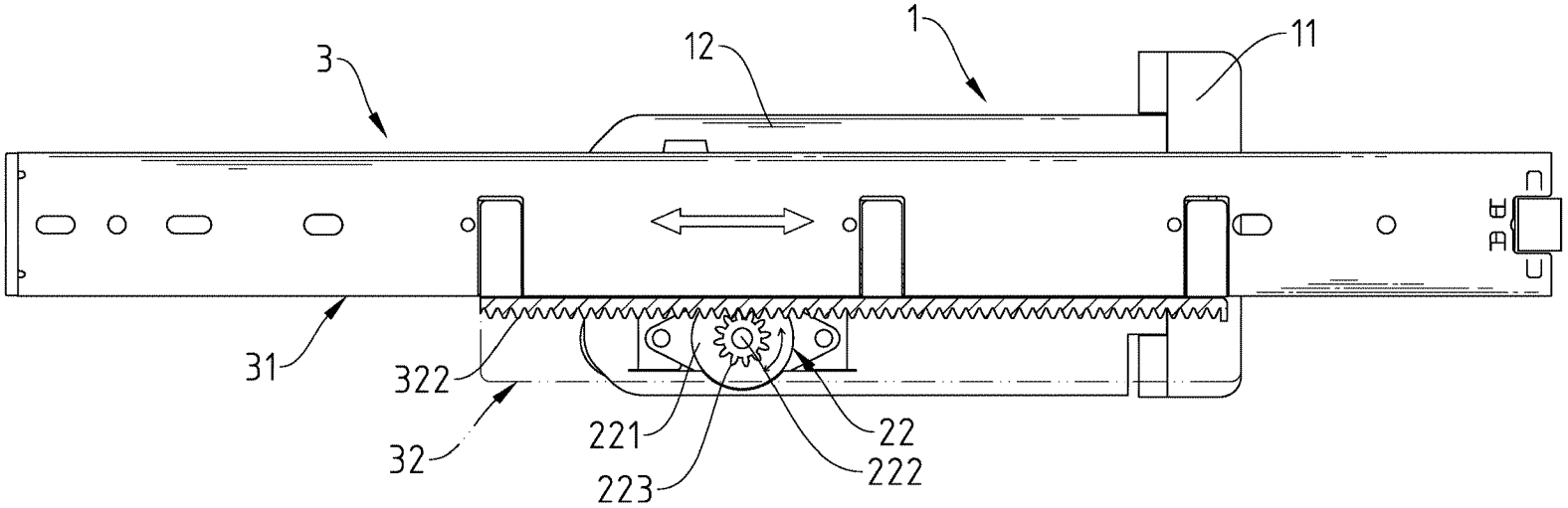
FIG. 3 is a schematic drawing of the present invention, illustrating the sliding device moved relative to the hinge.
Figure 4:
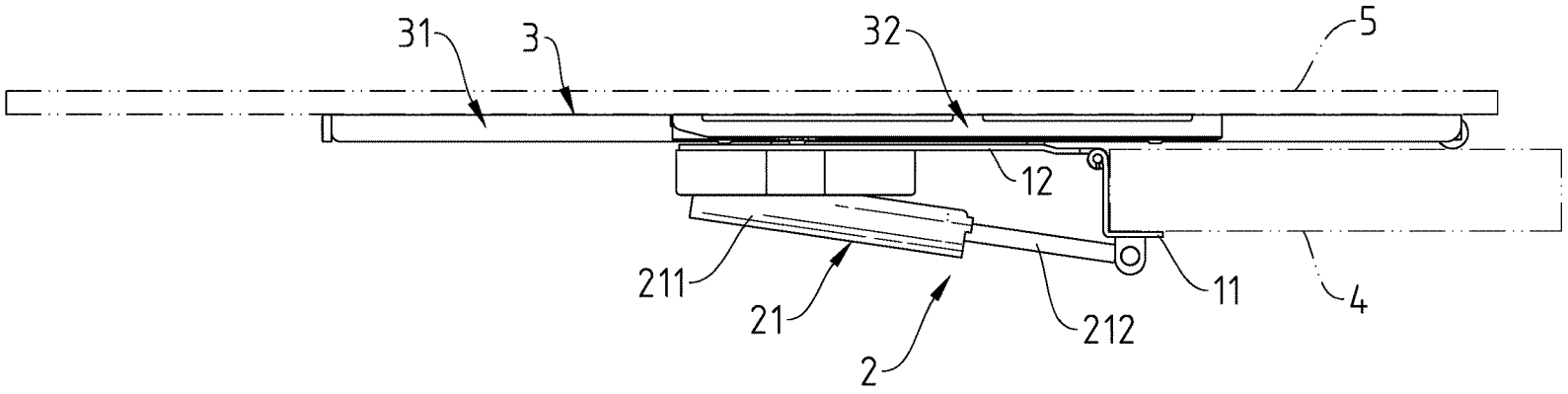
FIG. 4 is a schematic applied view of the present invention, illustrating the anti-fall flip-up sliding mechanism mounted between a cabinet and a door panel.
Figure 5:
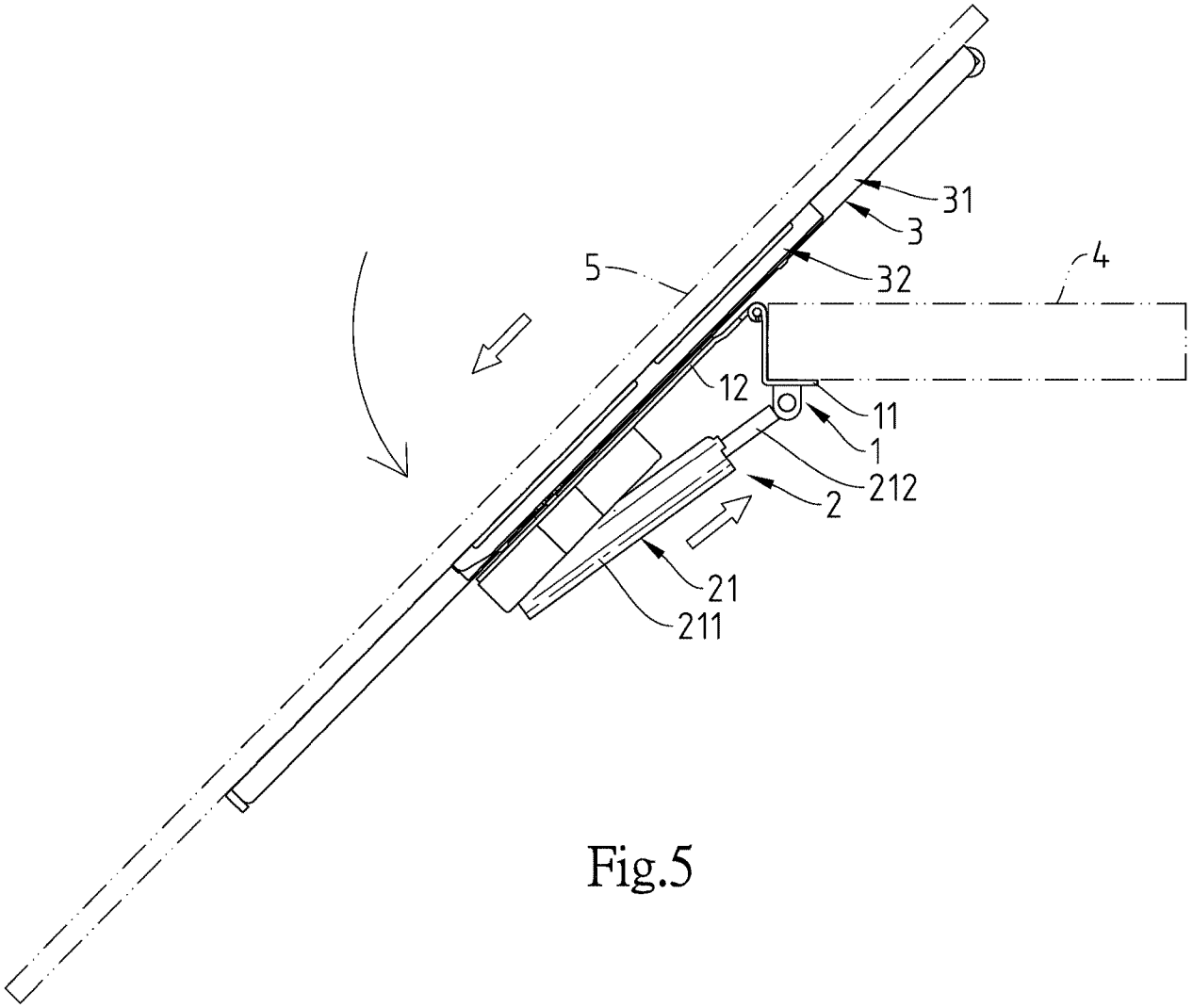
FIG. 5 is a schematic drawing of the present invention, illustrating the buffering device in action.

Referring to FIGS. 2, 3 and 5, when the user pulls the door panel 5 from the top side of the cabinet 4 for closing on the cabinet 4, the door panel 5 will be biased relative to the first hinge plate 11 of the hinge 1. At this time, the second hinge plate 12 is acted upon the first damper 21, forcing the piston rod 212 toward the inside of the first cylinder 211 to produce a buffering effect, avoiding sudden falling of the door panel 5. Further, when the door panel 5 is being pulled out of the top side of the cabinet 4, the sliding seat 31 of the sliding device 3 is moved along the track member 13 of the hinge 1. At this time, due to that the tooth rack 322 of the connecting seat 32 is meshed with the transmission gear 223 of the second damper 22, pulling the door panel 5 to move the sliding seat 31 simultaneously causes the transmission gear 223 to rotate the transmission gear 223 and the transmission axle 222, and thus, the second cylinder 221 is caused to produce a buffering effect, avoiding sudden falling of the door panel 5.

What is claimed is:

1. An anti-fall flip-up sliding mechanism, comprising:

a hinge comprising a first hinge plate configured to be affixed to a cabinet, and a second hinge plate pivotally connected to said first hinge plate;

a buffering device comprising a first damper connected between said first hinge plate and said second hinge plate, and a second damper mounted on said second hinge plate; and a sliding device coupled to and slidable relative to said second hinge plate of said hinge and engaged with said second damper of said buffering device, said sliding device configured to be affixed to a door panel for enabling said door panel to be buffered relative to said first hinge plate by said first damper and further configured to be connected to a top side of said cabinet and further buffered by said second damper;

wherein a track member is fixedly mounted on said second hinge plate of said hinge, said sliding device comprising a sliding seat connected to said track member and movable forward and backward relative to said track member, and a connecting seat connected to one side of said sliding seat and engaged with said second damper of said buffering device.

2. The anti-fall flip-up sliding mechanism as claimed in claim 1, wherein said sliding seat of said sliding device defines a sliding groove; said track member comprises an elongated track base affixed to said second hinge plate and slidably coupled to said sliding groove of said sliding seat, and two upright position-limiting side panels respectively extend along two opposite lateral sides of said track base in a parallel manner and are respectively supported on two opposite inner sidewalls of said sliding groove of said sliding seat.

3. The anti-fall flip-up sliding mechanism as claimed in claim 1, wherein said connecting seat of said sliding device comprises a position-limiting groove, and a tooth rack extends along one lateral side of said position-limiting groove; said second damper of said buffering device comprises a cylinder, a transmission axle coupled to said cylinder, and a transmission gear fixedly mounted on said transmission axle and disposed in said position-limiting groove of said connecting seat and meshed with said tooth rack.

4. The anti-fall flip-up sliding mechanism as claimed in claim 1, wherein said first damper of said buffering device comprises a cylinder affixed to said second hinge plate, and a piston rod coupled to and movable in and out of said cylinder with a distal end thereof pivotally connected to said first hinge plate.

* * * * *